US007758242B2

(12) United States Patent
May et al.

(10) Patent No.: US 7,758,242 B2
(45) Date of Patent: Jul. 20, 2010

(54) RECLOSEABLE ZIPPER WITH SEALANT ON INNER AND OUTER SURFACES OF CLOSURE MEMBERS

(75) Inventors: Timothy James May, Appleton, WI (US); Greg W. Melchoir, Green Bay, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 704 days.

(21) Appl. No.: 11/421,205

(22) Filed: May 31, 2006

(65) Prior Publication Data

US 2006/0285778 A1 Dec. 21, 2006

Related U.S. Application Data

(60) Provisional application No. 60/686,519, filed on Jun. 1, 2005.

(51) Int. Cl.
*B65D 33/16* (2006.01)
*A44B 19/00* (2006.01)

(52) U.S. Cl. ..... 383/63; 24/585.12

(58) Field of Classification Search ..... 383/61.2, 383/63, 210–211; 24/384, 585.1, 585.12; 53/455, 459, 469, 479
See application file for complete search history.

(56) References Cited

U.S. PATENT DOCUMENTS 3,440,696 A * 4/1969 Staller ..... 24/586.1
5,401,533 A 3/1995 Borland
5,489,252 A 2/1996 May
5,492,411 A 2/1996 May
5,603,995 A * 2/1997 Takubo et al. ..... 383/63
5,655,273 A * 8/1997 Tomic et al. ..... 24/585.12
5,709,915 A * 1/1998 Tomic et al. ..... 383/63
5,749,658 A * 5/1998 Kettner ..... 383/204
5,774,954 A 7/1998 Ramsey et al.
5,930,877 A 8/1999 Thorpe et al.
6,033,113 A * 3/2000 Anderson ..... 383/63
6,290,393 B1 * 9/2001 Tomic ..... 383/210.1
6,481,890 B1 * 11/2002 VandenHeuvel ..... 383/64
6,505,383 B2 * 1/2003 Machacek et al. ..... 24/30.5 R
7,036,988 B2 5/2006 Olechowski
7,171,730 B2 * 2/2007 Kasai ..... 24/30.5 R
7,263,813 B2 * 9/2007 Schneider et al. ..... 53/412
7,470,061 B2 * 12/2008 Plourde et al. ..... 383/64
2004/0014579 A1 1/2004 Sweeney et al.
2004/0022460 A1 * 2/2004 Plourde et al. ..... 383/64
2004/0025308 A1 * 2/2004 Kasai ..... 24/585.12

(Continued)

FOREIGN PATENT DOCUMENTS

EP 0 239 319 A2 3/1987

(Continued)

*Primary Examiner*—Jes F Pascua
(74) *Attorney, Agent, or Firm*—Merchant & Gould P.C.

(57) ABSTRACT

A reclosable zipper having a sealant applied thereon, for use in a polymeric bag. The reclosable zipper includes a first and second closure member, with each closure member having an interior surface and an exterior surface. A first sealant is present on the exterior surface of each of the first and second closure profiles; this sealant is used to attach a polymeric film that forms a bag body. A second sealant is present on the interior surface of each of the first and second closure profiles; this sealant enhances the seal between the closure profiles at the side edges of the bag.

9 Claims, 3 Drawing Sheets

U.S. PATENT DOCUMENTS

2004/0091179 A1* 5/2004 Anderson ..... 383/63
2004/0091186 A1* 5/2004 Shibata ..... 383/210
2004/0131283 A1* 7/2004 Sprague et al. ..... 383/61.2
2005/0279053 A1* 12/2005 Schneider et al. ..... 53/412
2005/0286810 A1* 12/2005 Sprague et al. ..... 383/61.2
2005/0286811 A1* 12/2005 Sprague et al. ..... 383/61.2
2005/0286812 A1* 12/2005 Sprague et al. ..... 383/61.2
2007/0098305 A1* 5/2007 Tilman ..... 383/64

FOREIGN PATENT DOCUMENTS

EP 0 388 364 A1 3/1990
WO WO 98/24704 6/1998

* cited by examiner

RECLOSEABLE ZIPPER WITH SEALANT ON INNER AND OUTER SURFACES OF CLOSURE MEMBERS

CROSS-REFERENCE TO RELATED APPLICATION

This application claims the benefit of U.S. Provisional Patent Application Ser. No. 60/686,519, filed Jun. 1, 2005, entitled "Reclosable Zipper with Sealant on Inner and Outer Skirts", which application is hereby incorporated by reference in its entirety.

FIELD

This disclosure is directed to reclosable bags. More particularly, this disclosure is directed to reclosable bags having adhesive material present on inner and outer surfaces of closure members that form the zipper of the reclosable bag.

BACKGROUND OF THE INVENTION

As can be seen from FIG. 1, a reclosable bag 2 includes a reclosable zipper 4 that extends along the length of the reclosable bag 2 from a first side edge to the opposite side edge. The reclosable zipper 4 includes a first flange or closure member 6 and a second flange or closure member 8. First closure member 6 and second closure member 8 mate and unmate, seal and unseal, and otherwise close and open to provide access to the interior of bag 2. First closure member 6 includes a first profile 12 and second closure member 8 includes a second profile 14. First profile 12 is adapted to receive second profile 14.

Attached to the each of members 6, 8 is a polymeric panel or film 18 that forms the overall body of bag 2. Usually, members 6, 8 are extruded polymer. Each panel 18 is attached to its corresponding member 6, 8 by a sealant that has a lower melting point than either of members 6, 8, to inhibit members 6, 8 from melting when panels 18 are attached, which is typically done by the application of heat and pressure. In FIG. 1, polymeric panel 18 is attached to each of members 6, 8 by a sealant that is applied onto the exterior surface of each member 6, 8.

The process of manufacturing a reclosable bag containing a product typically involves three steps. First, a polymeric film is folded in half to form a first panel and a second panel. The first panel is attached to the first closure member and the second panel is attached to the second closure member. As described above, the panels or films are attached to the closure members by a sealant which is applied onto the exterior surface of each member. Heat, which melts the sealant between the closure member and the panel, is applied to fuse the polymeric panel its corresponding closure member. At this particular moment, the reclosable bag has a first edge and a second edge.

After the first and second members have been attached to their respective panel or film, the first and second ends of the reclosable bag are formed by fusing the first panel to the second panel. The panels are fused together by applying enough heat to melt the panels together thereby creating a seal between the first panel and the second panel. The heat that is used to form the first and second ends of the reclosable bag also seals the first and second ends of the first closure member to the ends of the second closure member, i.e. the first and second ends of the first closure member are fused to the first and second ends of the second closure member, respectively. This occurs because the heat that is applied to form the first and second ends of the reclosable bag is above the melting temperature of each closure member. Due to the rapid speed at which the first and second ends of the reclosable bag are formed, however, the first and second ends of the first closure member are occasionally not sealed to the corresponding ends of the second closure member. In other words, occasionally the first and second ends of the zipper are not completely sealed.

After the first and second ends of the reclosable bag have been created, the reclosable bag is filled with a product and usually sealed by locking the first closure member to the second closure member. The first and second closure members are locked together by mechanically engaging the first profile to the second profile. This is typically achieved by applying a force that pushes or crushes the profiles together.

After the reclosable bag has been formed, filled, and sealed, the bag is separated or "cut-off" from adjacent bags exposing the first and/or second ends of the zipper to the atmosphere. If the first and second ends of the zippers are not completely sealed, then the product that is contained within the reclosable bag may spoil as air is introduced into the interior of the reclosable bag by diffusing or otherwise flowing between the opposing interior surfaces of the first and second closure member. The seal is not hermetic.

In order to reduce the probability of having unsealed zipper ends, the rate at which the reclosable bags are produced is typically decreased. This increases the probability that sufficient heat is applied to both ends of the zipper for an adequate amount of time to seal the zipper's first closure member to the second closure member. One drawback to this method, however, is that the total number of reclosable bags produced over a given amount of time is reduced.

Therefore, there exists a need for a reclosable bag having a hermetic seal that can be produced at a high rate of speed.

This invention responds to this need by providing a zipper having a sealant applied onto the interior surfaces of the zipper thereby ensuring that a hermetic seal is formed when the reclosable bag is sealed.

SUMMARY OF THE DISCLOSURE

The present disclosure is to a reclosable zipper having a sealant applied thereon, and a bag made with the zipper. The reclosable zipper includes a first and second closure member for opening and closing the zipper. A first sealant is present on the exterior surface of the first and second closure members; this sealant is used to attach a polymeric film that forms the body of the bag. A second sealant is present on the interior surface of each of the first and second closure members, to improve the seal between the closure members at the side edges of the bag.

In one particular aspect, this disclosure is to a reclosable zipper comprising a first closure member and a second closure member, each closure member having a first edge, a second edge opposite the first edge, a first end, a second end, an interior surface, and an exterior surface. Each closure member has a closure profile present on the interior surface between the first edge and the second edge, wherein the closure profile of the first closure member is configured to releasably engage with the closure profile of the second closure member. A first sealant is present on the outer surface of each of the first and second closure members, the sealant having a melting temperature less than the melting temperature of the closure members. A second sealant is present on the interior surface of each of the first and second closure members, the second sealant located between the second edge and the closure profile, the second sealant having a melting temperature less than the melting temperature of the closure members. The second sealant on the first closure member is sealed to the second sealant on the second closure member at the first and second ends of the closure members, but is not sealed, or is unsealed, at a location between the first and second ends of the closure members. This second sealant may be present at only the ends of the closure members or may extend their length.

In another particular aspect, this disclosure is to a reclosable zipper comprising a first closure member and a second closure member, each closure member having a first edge, a second edge, a first end, a second end, an interior surface, and an exterior surface. There is a first profile extending from the interior surface of the first closure member, the first profile being mechanically engageable with a second profile extending from the interior surface of the second closure member. The zipper includes a first sealant on the outer surface of each of the first and second closure members adjacent to the first edge. A polymeric film is attached to the outer surface of each of the first and second closure members by the first sealant. Also included is a second sealant on the interior surface at the first end and the second end of each of the first and second closure members adjacent to the second edge, the second sealant on the first closure member being affixed to the second sealant on the second closure member at the first and second ends of the closure members, and not at a location between the first and second ends.

This disclosure, in another aspect, is to a reclosable bag having a first side edge and a second side edge, the bag having a reclosable zipper. This zipper includes a first closure member and a second closure member, with each of the closure members having a first edge, a second edge, an interior surface, and an exterior surface, each of the closure members having a closure profile present on the interior surface between the first edge and the second edge, and wherein the closure profile of the first closure member is configured to releasably engage with the closure profile of the second closure member. A polymeric film is attached to the exterior surface of each of the closure members by a first sealant having a melting temperature less than a melting temperature of the closure member and less than a melting temperature of the polymeric film. A second sealant is on the interior surface of each of the first and second closure members at the first side edge and second side edge of the bag, the second sealant present between the second edge and the closure profile of each of the closure members, the second sealant on the first closure member sealed to the second sealant on the second closure member at the first side edge and the second side edge of the bag and not at a location between the first side edge and the second side edge, the second sealant having a melting temperature less than a melting temperature of the closure member and less than a melting temperature of the polymeric film.

This disclosure is also to a method of making a reclosable zipper, the method including extruding a polymeric resin to form a closure member having an interior surface and an exterior surface, with a closure profile extending from the interior surface, applying a first sealant on the exterior surface of the closure member, the first sealant having a melting temperature less than a melting temperature of the closure member, and applying a second sealant on the interior surface between an edge of the closure member and the closure profile, the second sealant having a melting temperature less than a melting temperature of the closure member. Applying of the first sealant and/or the second sealant can be by co-extruding either or both sealants with the closure profile.

Also provided is a method of making a reclosable bag, the method comprising providing a zipper having a first closure member and a second closure member, each of the first and the second closure member having a first edge, a second edge, a first end, a second end, an interior surface, and an exterior surface, and a closure profile extending from the interior surface; applying onto the interior surface of each of the first and the second closure members a sealant having a melting temperature less than a melting temperature of the closure members; attaching a first panel to the exterior surface of the first closure member and attaching a second panel to the exterior surface of the second closure member; then heating the first and second panels to fuse the first panel to the second panel and form a first side edge and a second side edge; and heating the first closure member and the second closure member at the first side edge and the second side edge to fuse the second sealant on the first closure member to the second sealant on the second closure member at the first side edge and at the second side edge, but not at a location between the first side edge and the second side edge.

DETAILED DESCRIPTION

Figure 1:
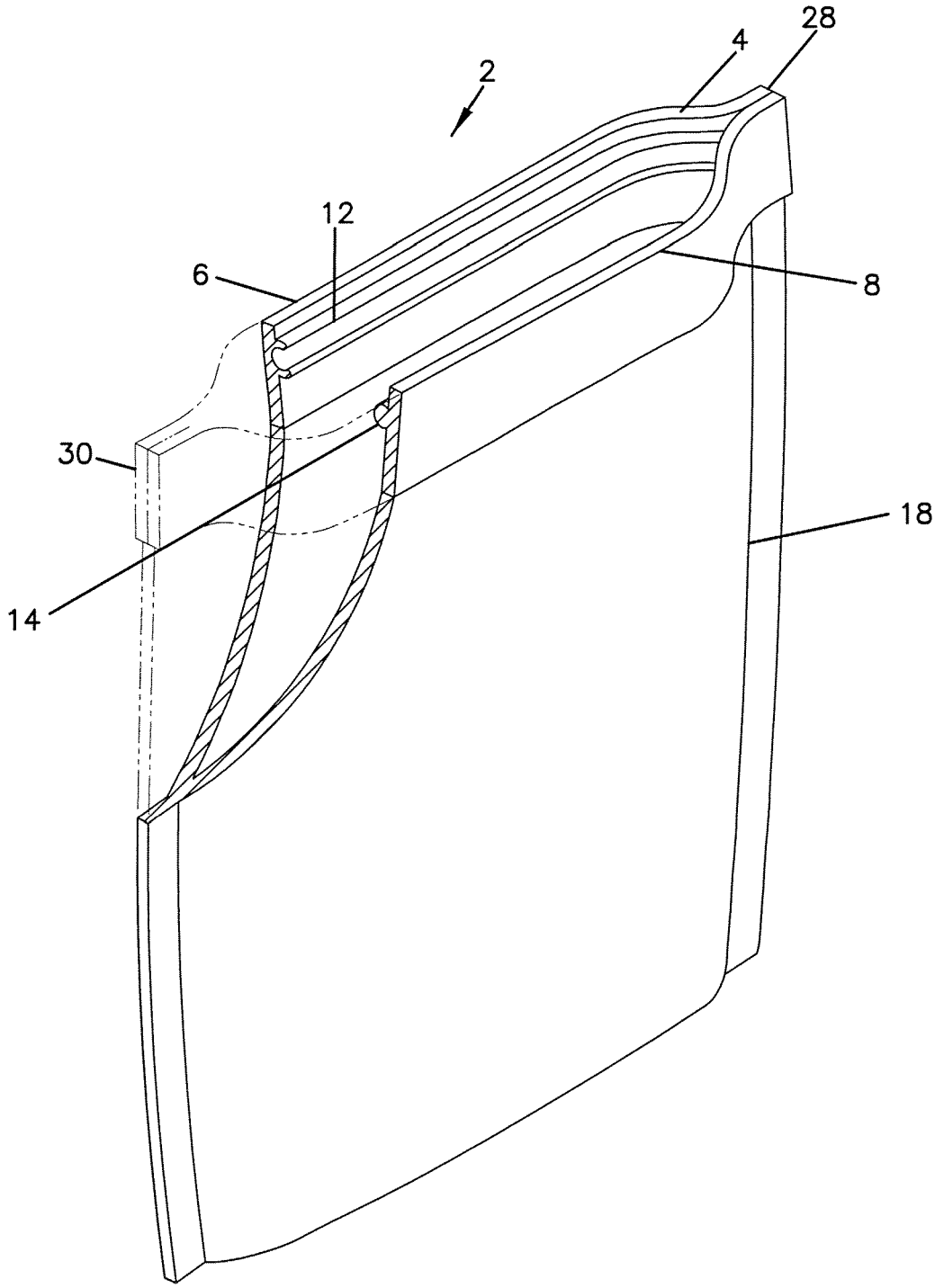
FIG. 1 PRIOR ART
FIG. 1 is a perspective view of a reclosable bag.

The accompanying figures and the description that follows set forth this invention in its preferred embodiments. However, it is contemplated that persons generally familiar with reclosable bags and zippers will be able to apply the novel characteristics of the structures and methods illustrated and described herein in other contexts by modification of certain details. Accordingly, the figures and description are not to be taken as restrictive on the scope of this invention, but are to be understood as broad and general teachings. When referring to any numerical range of values, such ranges are understood to include each and every number and/or fraction between the stated range minimum and maximum. For purposes of the description hereinafter, the terms "upper", "lower", "right", "left", "vertical", "horizontal", "top", "bottom", and derivatives thereof shall relate to the invention, as it is oriented in the drawing figures.

Figure 2:
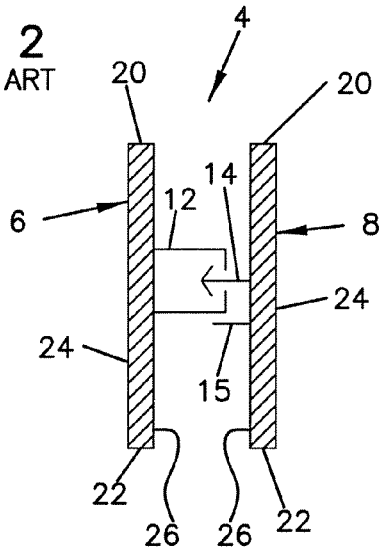
FIG. 2 PRIOR ART
FIG. 2 is an end view of a conventional zipper design having a first closure member and a second closure member.

As can be seen from FIG. 2, existing reclosable zipper designs typically include zipper 4 having a first member 6 and a second member 8. Each of members 6, 8 has a first edge 20, a second edge 22 opposite the first edge 20, an exterior surface 24, and an interior surface 26. Closure members 6, 8 are positioned so that interior surfaces 26 are facing each other. When incorporated into a bag, such as bag 2 of FIG. 1, each of members 6, 8 also has a first end 28 and a second end 30, which generally correspond to the side edges of bag 2. Returning to FIG. 2, as illustrated, first and second members 6, 8 are oriented substantially vertically. First closure member 6 includes a first profile 12, which, in the exemplified embodiment, extends substantially perpendicularly, i.e. horizontally in FIG. 2, from interior surface 26 of first closure member 6. Second closure member 8 includes a second profile 14, which, in the exemplified embodiment, extends substantially perpendicularly from interior surface 26 of second closure member 8.

First profile 12 is configured and adapted to engage with second profile 14. First and second profiles 12, 14, which could also be referred to as locking members, are adapted to mechanically engage with one another thereby locking first member 6 to second member 8 and closing the reclosable bag 2. In some embodiments, first and second profiles 12, 14 are female and male profiles, configured for the female profile to receive at least a portion of the male member. In FIG. 2, second profile 14 includes a guide member 15 that extends substantially perpendicularly from interior surface 16 of second closure member 16 and substantially parallel to second profile 14. Guide member 15 aids in guiding second profile 14 into engagement with first profile 12.

Figure 3:
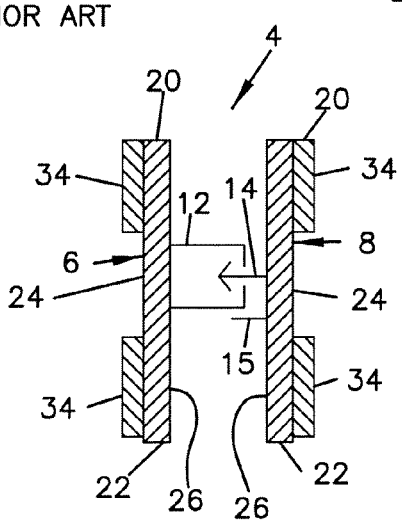
FIG. 3 PRIOR ART
FIG. 3 is an end view of the conventional zipper design with sealant present on the exterior surface of the closure members.

FIG. 3 illustrates zipper 4 of FIG. 2 having added thereon an adhesive sealant, particularly a low temperature melting sealant, present on exterior surface 24 of each member 6, 8. As described in the preceding paragraph, reclosable zipper 4 includes first and second members 6, 8 that extend substantially vertically. Closure members 6, 8 of FIG. 3 are as described in respect to FIG. 2, having first edge 20, second edge 22, exterior surface 24, interior surface 26, first end 28, and second end 30. Closure members 6, 8 also include first profile 12 and second profile 14, respectively, configured to mechanically engage with one another to lock first member 6 to second member 8. Guide member 15 is also present.

In conventional zipper designs, a low temperature melting sealant is applied only to exterior surface 24 of each member 6, 8. The low temperature melting sealant present on exterior surface 24 of each member 6, 8 is indicated as first sealant 34. As can be seen from FIG. 3, first sealant 34 is typically applied at two locations, a first location adjacent to first edge 20 of each member 6, 8 and a second location adjacent to second edge 22 of each member 6, 8. Sealant 34 is used to attach film 18 (FIG. 1) to closure members 6, 8.

Figure 4:
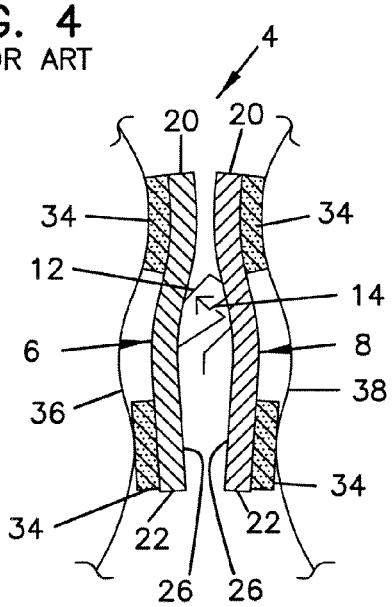
FIG. 4 PRIOR ART
FIG. 4 is an end view of the conventional zipper design with first and second closure members interlocked via first and second profiles and a polymer film attached to each of the closure members.

FIG. 4 depicts zipper 4 of FIG. 3 with first member 6 attached to the first panel section 36 and second member 8 attached to the second panel section 38. Each of panel sections 36, 38 is a sheet of a polymeric material. Sealant 34, on exterior surface 24 of each member 6, 8 adjacent first and second edges 20, 22, connects each panel 36, 38 to its corresponding member 6, 8.

FIG. 4 also depicts first profile 12 mechanically engaged to second profile 14, which locks first closure member 6 to second closure member 8. Each of profiles 12, 14 is mechanically engaged to one another by applying a force that urges profiles 12, 14 together after second profile 14 has been received by first profile 12. At ends 28, 30 of zipper 4, profiles 12, 14 are permanently joined together, e.g., crushed, melted, and/or flattened.

One drawback, however, of applying first sealant 34 only to exterior surface 24 of each member 6, 8 is when zipper 4 has been incorporated into reclosable bag 2, such as by a form, fill and seal process, reclosable bag 2 has a tendency to leak at one or both ends 28, 30. This leak is through the area between interior surfaces 26 and below profiles 12, 14. Accordingly, the contents of these reclosable bags 2 have a tendency to leak or spill out, and/or spoil, because these bags lack a hermetic, i.e. airtight, seal.

Figure 5:
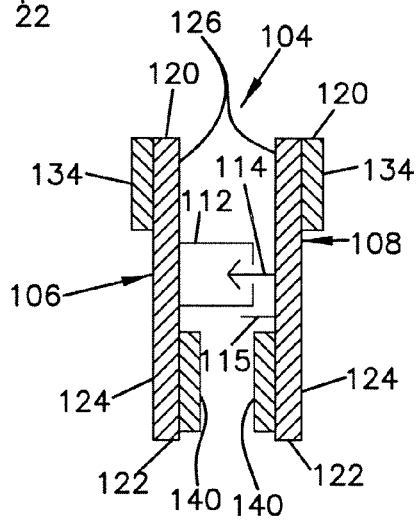
FIG. 5 is an end view of a zipper with sealant, in accordance with the present invention.

FIG. 5 provides one embodiment of a zipper in accordance to the present invention. Similar to zipper 4 of FIGS. 2-4, reclosable zipper 104 in FIG. 5 includes a first closure member 106 and a second closure member 108, both which extend substantially vertically. Each of the closure members 106, 108 has a first edge 120, a second edge 122 opposite first edge 120, an exterior surface 124, and an interior surface 126. Closure members 106, 108 are positioned so that the two interior surfaces 126 are facing each other.

First closure member 106 includes a first profile 112 that extends from interior surface 126; in the embodiment illustrated in FIG. 5, first profile 112 extends substantially perpendicularly from interior surface 126 of first member 106. Second closure member 108 includes a second profile 114 that extends from interior surface 126; in the embodiment illustrated in FIG. 5, second profile 114 extends substantially perpendicularly from interior surface 126 of second member 108. First profile 112 is adapted to receive and to mechanically engage with second profile 114, thereby locking first member 6 to second member 8. A guide member 115 may be present to aid in guiding second profile 114 into first profile 112; in the illustrated embodiment, guide member 115 extends substantially perpendicularly from interior surface 126 of second member 108.

Even though FIG. 5 depicts first and second profiles 112, 114 as extending from the interior surface 126 of first and second members 106, 108 near the center of each member 106, 108, profiles 112, 114 may additionally or alternatively extend from interior surface 126 near first edge 120 of each member 106, 108, or from interior surface 126 near second edge 122 of each member 106, 108, and not depart from this invention.

Figure 7:
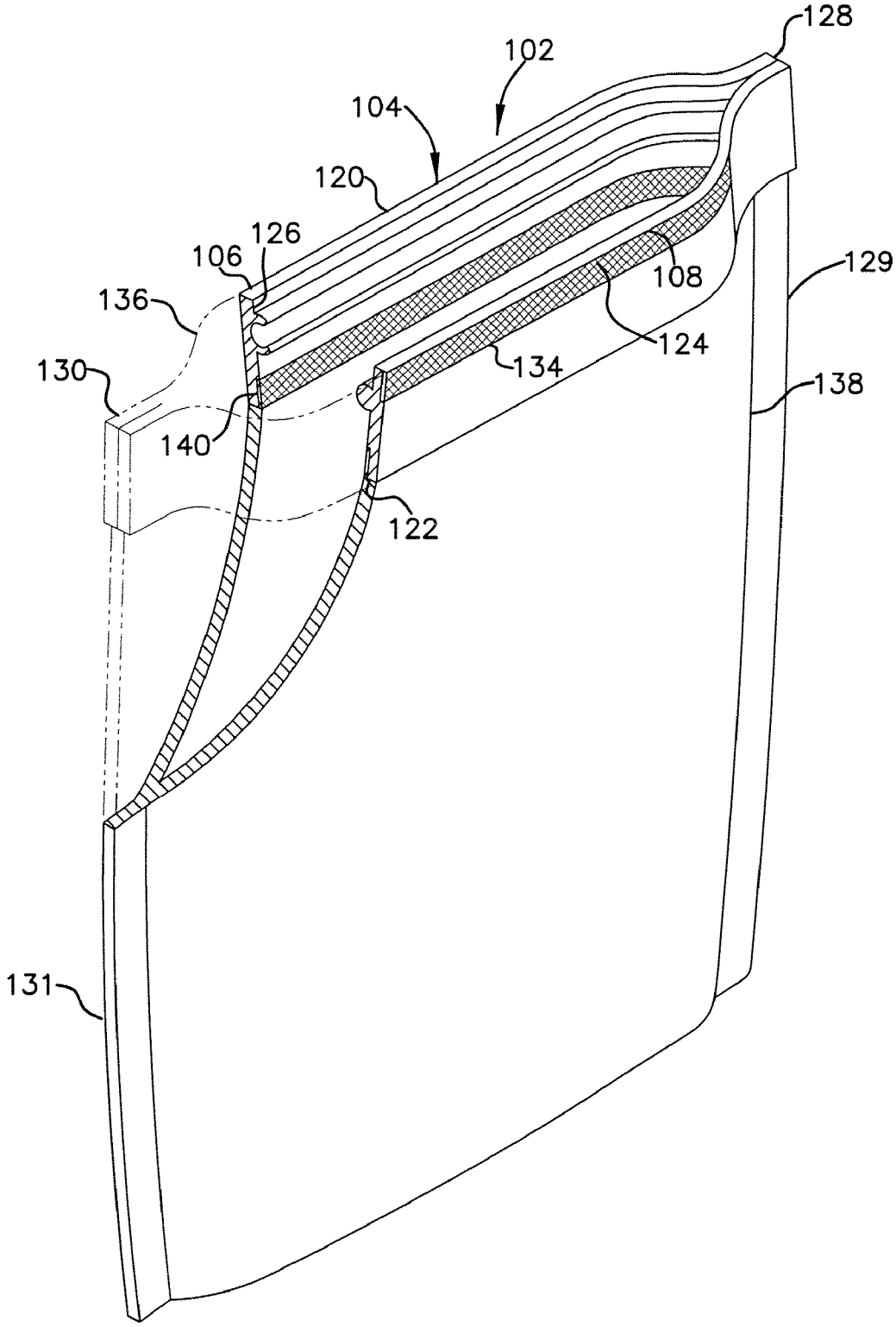
FIG. 7 is a perspective view of a reclosable bag having the zipper in accordance with the present invention.

When incorporated into a package, such as bag 102 of FIG. 7, each closure member 106, 108 has a first end 128 and a second end 130, which correspond generally to the side edges 129, 131 of bag 102.

Reclosable zipper 104 shown in FIG. 5 includes a low temperature melting sealant on each member 106, 108 at two distinct locations. A first sealant 134 is present on exterior surface 124 of each member 106, 108 adjacent to first edge 120. Unlike reclosable zipper 4 of FIGS. 3-4 however, zipper 104 of FIG. 5 includes low temperature melting sealant on interior surface 126 of each member 106, 108; this sealant on interior surfaces 126 is referred to as a second sealant 140. Second sealant 140 is present on interior surface 126 of each member 106, 108 adjacent to second edge 122.

In many embodiments, second sealant 140 extends from second end 122 to profiles 112 and 114 (which may include guide member 115). In some embodiments, second sealant 140 may extend over profiles 112, 14 and even above profiles 112, 114 (i.e., be present between profiles 112, 114 and first end 120). If profiles 112, 114 were positioned at or proximate to first end 120, second sealant 140 could cover a substantial portion of interior surface 126 of each member 106, 108.

In an alternate embodiment, each member 106, 108 has two profiles, such as first profile 112 and second profile 114, extending from interior surface 126 of member 106, 108. In such an embodiment, second profile 114 extending from first member 106 would be received into first profile 112 that is located on second member 108, and second profile 114 that extends from second member 108 will be received into first profile 112 that is located on first member 106.

It should be understood that although generic areas or volumes of first sealant 134 and second sealant 140 have been illustrated in the figures, these sealants 134, 140 may be non-continuous coatings, having various patterns and/or shapes. For example, either or both sealant 134, 140 may be present as a coating having a plurality of circular dots, diamonds, parallel straight lines, parallel oscillating lines, intersecting lines, or other patterns and/or shapes having uncoated areas therebetween. The sealant may be present as a single dot or post or other unitary area. It is usually preferred, however, that when closure members 106, 108 are sealed together via second sealant 140, the area of sealant 140 is continuous and uninterrupted in the vertical direction (i.e., between second end 122 and profile 112, 114). As described further below, sealant 140 of first closure member 106 and sealant 140 of second closure member 108 are sealed together only at ends 128, 130 of zipper 104; that is, sealant 140 of first closure member 106 and sealant 140 of second closure member 108 are not sealed together the entire length of zipper 104.

Figure 6:
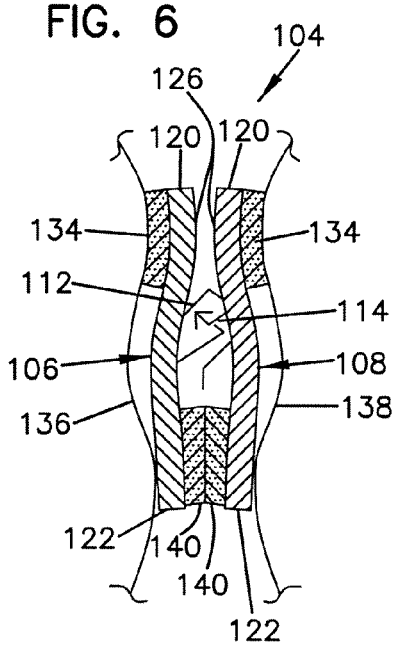
FIG. 6 is an end view of the zipper of FIG. 5 with interlocked first and second profiles and a polymer film attached to each side of the closure members.

Similar to FIG. 4, FIG. 6 depicts zipper 104 attached to panel sections, specifically, first member 106 attached to a first panel section 136 and second member 108 attached to a second panel section 138. Each of panel sections 136, 138 is typically a polymeric web material. In FIG. 6, profiles 112, 114 have been mechanically engaged. Additionally, since this is an end view of zipper 104, e.g., taken from either end 128 or end 130, profiles 112, 114 are permanently joined together, e.g., crushed, melted, and/or flattened.

Again similar to FIG. 4, each panel section 136, 138 in FIG. 6 is fixed to its corresponding member 106, 108 by the first sealant 134 on exterior surface 24 of each member 106, 108 adjacent to the first edge 120. In some embodiments, it may be desired to include a second area of first sealant 134 on exterior surface 124, to increase the attachment strength of panels 136, 138.

As shown in FIG. 6, second sealant 140 on first member 106 is affixed to second sealant 140 on second member 108, which is at ends 128, 130. By sealing each of second sealants 140 together at ends 128, 130, together with the engaging of profile 112 with profile 114 across the length of zipper 104 (from end 128 to end 130), an airtight seal is formed along the length of reclosable zipper 104.

It is understood that second sealant 140 would not be sealed together the length of zipper 104, as that would seal off access to the contents within package 102. Rather, second sealants 140 are adhered together at first end 128 and second end 130, which is implemented during forming of side edges 129, 131 of bag 102, as will be described below. The sealant 140 present between ends 128, 130 is unsealed.

Referring to FIG. 7, a reclosable bag 102 is illustrated having reclosable zipper 104 incorporated therein, with first closure member 106 attached to panel 136 and second closure member 108 attached to panel 138. First and second sealants 134, 140 on closure members 106, 108 generally extend the length of first and second members 106, 108, from first end 128 to second end 130. In other embodiments, one or both of first and second sealants 134, 140 might be present at ends 128, 130 but not the entire length of zipper 104.

In many embodiments, bag 102 is made by a form, fill and seal process. After reclosable bag 102 is filled with a product, bag 102 is sealed to prevent the product in bag 102 from spoiling. Bag 102 is closed by mechanically engaging first and second profiles 112, 114, which causes first member 106 to be locked to second member 108. In order to ensure that a hermetic seal is established between first and second members 106, 108, heat is applied to second sealant 140, thereby sealing second sealant 140 that is located on interior surface 126 of first member 106 to second sealant 140 that is located on interior surface 126 of second member 108. By sealing second sealant 140 on first member 106 to second sealant 140 on second member 108, an airtight seal is formed along the length of the interlocked first and second members 106, 108.

The low temperature melting sealant, i.e., first sealant 134 and second sealant 140, may be any of numerous low temperature melting compounds used for adhering materials together. Preferably, however, sealants 134, 140 are preferably hot melt materials or include a hot melt compound. Examples of suitable compounds include, for example, metallocene, ethylene vinyl acetate (EVA), ethylene acid copolymers such as SURLYN®, and ethylene-acrylic acid copolymers such as NUCREL®. First sealant 134 may be the same or different than second sealant 140. Generally, the compound used in first and second sealants 134, 140 would begin to melt at temperature below the melting temperature of panels 136, 138 and below the melting temperature of closure members 106, 108. In many embodiments, the melting temperature difference between sealants 134, 140 and panels 136, 138 and/or closure members 106, 108 is at least 1° C., often at least 2° C. In other embodiments, the melting temperature difference is at least 3° C. or at least 4° C. Some embodiments even have a melting temperature difference of at least 5° C. In many embodiments, the sealant softening temperature or initial melting temperature is about 71° C. (160° F.) to about 74° C. (165° F.).

Closure members 106, 108 are formed by extruding polymeric resin, when in an at least partially molten state, through an extrusion die. Typically, low temperature melting sealant is co-extruded with the polymeric resin to produce a member that includes sealant, e.g., first sealant 134 and second sealant 140, located as appropriate. In alternate embodiments, one or both sealants 136, 140 could be applied to closure members 106, 108 subsequent to their extrusion, for example, by a post-coating process. In most embodiments, the thickness of sealant 134, 140 is about 0.0127 mm (0.0005 in) to about 0.0254 mm (0.001 in).

This disclosure also provides methods for making reclosable bags having the zipper of the present invention. The overall steps of forming, filling, and sealing the reclosable bag of this invention are similar to what was described above.

First, a polymeric film is folded in half to form a first panel (e.g., panel 136) and a second panel (e.g., panel 138). The first panel is attached to the first closure member (e.g., closure member 106) and the second panel is attached to the second closure member (e.g., closure member 108). In an alternate process, two polymeric film sheets may be used. The first film is attached to the first closure member, the second film is attached to the second closure member, and the two films are attached together at their bottom edge to form a seam.

In accordance with the present invention, the panels or films (e.g., panels 136, 138) are attached to the closure members (e.g., closure members 106, 108) by a first sealant (e.g., sealant 134) present on the exterior surface of each closure member. Heat and/or pressure are applied to activate (e.g., melt) the first sealant between the closure member and the panel in order to fuse the polymeric panel to its corresponding closure member. Because the first sealant has a lower melting temperature than the panels and the closure members, the sealant activates but the panels and closure members remain generally unmelted or otherwise damaged.

After the first and second closure members have been attached to their respective panel or film, the first and second edges (e.g., edges 129, 131) of the reclosable bag are formed by fusing the first panel (e.g., panel 136) to the second panel (e.g., panel 138). The panels are fused together by applying enough heat and/or pressure to melt the panels together, thereby creating a seal between the first panel and the second panel. The heat and/or pressure that is used to form the first and second edges of the reclosable bag (e.g., edges 129, 131) also seals the first and second ends (e.g., ends 128, 130) of the zipper (e.g., zipper 104) by permanently fusing first closure member (e.g., closure member 106) to the corresponding ends on the second closure member (e.g., closure member 108). That is, the first and second ends of the first closure member are fused to the first and second ends of the second closure member. This heat and/or pressure applied to form the first and second edges of the reclosable bag is sufficient to at least partially melt and crush or distort each closure member at their ends (e.g., ends 128, 130), thus causing the closure members to permanently fuse together at their ends.

After the first and second edges of the reclosable bag have been created, the reclosable bag is filled with a product. After the reclosable bag has been filed with the product, the bag is usually sealed by locking the first closure member to the second closure member, by mechanically engaging the first profile with the second profile. As the first and second profiles are being mechanically engaged, generally heat is applied to the first and second closure members in order to melt the second sealant that is located on the interior surface of each closure member. Because the second sealant has a lower melting temperature than the panels and the closure members, the sealant activates but the panels and closure members remain generally unmelted or otherwise damaged. Activation of the sealant between the closure members causes the second sealant located on the first closure member to become fused with the second sealant located on the second closure member thereby forming a hermetic seal between the closure members. This activation of the sealant is done only at the zipper ends; the entire zipper is not sealed, as that would impede access to the interior of the bag; that is, a portion of the second sealant between the zipper ends is unsealed.

The size, shape, and number of the profile members that are used in the reclosable zipper is not meant to limit this invention. In other words, this invention can be implemented in zipper designs that utilize a second profile member having a substantially cylindrical shaft with an enlarged cone shaped head as well as second profiles having regular and irregular geometric shapes. Having described the presently preferred embodiments, it is to be understood that the invention may be otherwise embodied within the scope of the appended claims.

What is claimed is:

1. A reclosable zipper comprising:

a first closure member and a second closure member, each closure member having:

a first edge, a second edge opposite the first edge, a first end, a second end, an interior surface, and an exterior surface; and a closure profile present on the interior surface between the first edge and the second edge, wherein the closure profile of the first closure member is releasably engaged with the closure profile of the second closure member;

a first sealant present on the outer surface of each of the first and second closure members, the first sealant located adjacent to the first edge of each of the closure members, the sealant having a melting temperature less than the melting temperature of the closure members; and a second sealant present on the interior surface of each of the first and second closure members, the second sealant located between the second edge and the closure profile, the second sealant being continuous between the first and second ends of the closure members and having a melting temperature less than the melting temperature of the closure members, wherein the second sealant on the first closure member is sealed to the second sealant on the second closure member at the first and second ends of the closure members without the second sealant on the first closure member and the second sealant on the second closure member having been sealed together at a location between the first and second ends of the closure members;

wherein the surface of each closure member opposite the first sealant and the second sealant is free of sealant.

2. A reclosable zipper according to claim 1 wherein at least one of the first sealant and the second sealant is selected from the group consisting of metallocene, ethylene vinyl acetate (EVA), ethylene acid copolymers and ethylene-acrylic acid copolymers.

3. A reclosable zipper according to claim 2 wherein the first sealant is the same as the second sealant.

4. A reclosable zipper according to claim 1 wherein at least one of the first sealant and the second sealant has a melting temperature of about 71° C. (160° F.) to about 74° C. (165° F.).

5. A reclosable zipper according to claim 1 wherein the second sealant covers the entire inner surface between the second edge and the closure profile of each of the closure members.

6. A reclosable zipper and bag combination comprising:

a first closure member and a second closure member, each closure member having a first edge, a second edge, a first end, a second end, an interior surface, and an exterior surface;

a first profile extending from the interior surface of the first closure member, the first profile being releasably mechanically engaged with a second profile extending from the interior surface of the second closure member;

a first sealant on the outer surface of each of the first and second closure members adjacent to the first edge;

a polymeric film attached to the outer surface of each of the first and second closure members by the first sealant; and a second sealant on the interior surface at the first end and the second end of each of the first and second closure members adjacent to the second edge, the second sealant being continuous between the first and second ends of the closure members, the second sealant on the first closure member being affixed to the second sealant on the second closure member at the first and second ends of the closure members without the second sealant on the first closure member and the second sealant on the second closure member having been sealed together at a location between the first and second ends;

wherein the surface of each closure member opposite the first sealant and the second sealant is free of sealant.

7. A reclosable zipper and bag combination according to claim 6, wherein the second sealant present on the interior surface of the closure members covers the entire inner surface between the second edge and the closure profile of each of the closure members.

8. A reclosable bag having a first side edge and a second side edge, the bag comprising:

a reclosable zipper, the zipper comprising a first closure member and a second closure member, each of the closure members having a first edge, a second edge, an interior surface, and an exterior surface, each of the closure members having a closure profile present on the interior surface between the first edge and the second edge, wherein the closure profile of the first closure member is releasably engaged with the closure profile of the second closure member;

a polymeric film attached to the exterior surface of each of the closure members by a first sealant having a melting temperature less than a melting temperature of the closure member and less than a melting temperature of the polymeric film, the first sealant located adjacent to the first edge of each of the closure members; and a second sealant on the interior surface of each of the first and second closure members at the first side edge and second side edge of the bag, the second sealant present between the second edge and the closure profile of each of the closure members, the second sealant being continuous between the first and second side edges of the bag, the second sealant on the first closure member sealed to the second sealant on the second closure member at the first side edge and the second side edge of the bag without the second sealant on the first closure member and the second sealant on the second closure member having been sealed together at a location between the first side edge and the second side edge, the second sealant having a melting temperature less than a melting temperature of the closure member and less than a melting temperature of the polymeric film;

wherein the surface of each closure member opposite the first sealant and the second sealant is free of sealant.

9. A reclosable bag according to claim 8, wherein the second sealant covers the entire inner surface between the second edge and the closure profile of each of the closure members.

* * * * *